US007392606B2

(12) United States Patent
Uchikoshi

(10) Patent No.: US 7,392,606 B2
(45) Date of Patent: Jul. 1, 2008

(54) SHIRT FINISHING MACHINE

(75) Inventor: Mitsuyuki Uchikoshi, Tokyo (JP)

(73) Assignee: Sankousha Engineering Co., Ltd. (JP)

( * ) Notice: Subject to any disclaimer, the term of this patent is extended or adjusted under 35 U.S.C. 154(b) by 90 days.

(21) Appl. No.: 11/503,094

(22) Filed: Aug. 10, 2006

(65) Prior Publication Data

US 2008/0034622 A1 Feb. 14, 2008

(51) Int. Cl.
*D06F 71/18* (2006.01)
*A41H 5/02* (2006.01)
*D06F 71/16* (2006.01)

(52) U.S. Cl. ..... 38/16; 223/70

(58) Field of Classification Search ..... 223/68, 223/70, 71; 38/14, 16, 66
See application file for complete search history.

(56) References Cited

U.S. PATENT DOCUMENTS 2,667,291 A * 1/1954 Petrich ..... 223/70
3,066,839 A * 12/1962 Dosal ..... 223/67
3,434,910 A * 3/1969 Jurascheck et al. ..... 156/583.3
3,497,117 A * 2/1970 Rebiscoul ..... 223/73
3,568,900 A * 3/1971 Paris ..... 223/70
3,613,969 A * 10/1971 Forse ..... 223/37
3,715,064 A * 2/1973 North et al. ..... 223/57
5,474,216 A * 12/1995 Harrod et al. ..... 223/57
5,970,637 A * 10/1999 Mohan et al. ..... 38/22
6,032,837 A * 3/2000 Uchikoshi ..... 223/70

* cited by examiner

*Primary Examiner*—Ismael Izaguirre
(74) *Attorney, Agent, or Firm*—Andrus, Sceales, Starke & Sawall, LLP

(57) ABSTRACT

This invention comprises a torso 2 for putting on a shirt 1 thereon and press irons 3 to depress the front part and rear part of the torso 2 to press finish the shirt 1. The torso 2 is formed by plates 2*a*, 2*b* oppositely arranged at the front part and rear part. The present invention is made such that the steam flowing pipe *4* for use in heating the front side plate 2*a* is arranged at a position corresponding to the front part 1*a* of the shirt 1 at the rear side of the front side plate 2*a*. When the product of the present invention is used, it is possible to finish the front bodice of the shirt having the cloth overlapped portions rapidly and thus it is possible to increase an efficiency of the pressing operation.

3 Claims, 4 Drawing Sheets

SHIRT FINISHING MACHINE

BACKGROUND OF INVENTION

1. Field of the Invention

This invention relates to a shirt finishing machine and more particularly a shirt finishing machine for press finishing the shirt under a state in which the shirt such as a washed white shirt and the like is put on a torso.

2. Description of the Related Art

As this type of prior art shirt finishing machine, there has been provided the machine described in the gazette of U.S. Pat. No. 6,032,837, for example. This type of prior art shirt finishing machine comprises a torso for putting on a shirt, and a press iron for depressing the front part and rear part of the torso to press finish the shirt. The aforesaid torso is formed by plates oppositely arranged at the front part and the rear part.

In view of the foregoing, the shirt such as a white shirt is provided with a front bodice having cloth overlapped portions. More practically, these overlapped portions correspond to a front part (a part where front buttons and button holes are formed and the part extending from the throat to the lower end of the front bodice) or a position of pocket. The front part is set such that each of the front button side and the button hole side has a cloth folded back inside the shirt. Accordingly, when the shirt is put on the torso, the cloth becomes overlapped in four plies and becomes thick. In addition, when a pocket is sawn at the front bodice, the pocket cloth and the cloth at the front bodice corresponding to the pocket portion become overlapped to each other in two plies. In addition, since the location of port of the pocket has normally the cloth folded back inside the shirt, they are gathered together with the cloth at the front bodice and become three plies.

Thus, this type of finishing machine has a structure in which the torso is pressed with the press iron (hot iron), some wrinkles at the front bodice of the shirt put on the torso are extended with pressure and heat of the press iron to finish the shirt. Accordingly, this type of finishing machine required that the press iron should be continued to be pressed against the torso until the front bodice location was completely dried even if the front bodice was completely dried. As a result, inn accordance with the prior art machine, it had a problem that it took much time for finishing the front bodice of the shirt and its working efficiency was not improved.

This invention has been provided in view of the prior art problems.

Accordingly, the technical theme of the present invention to be solved is to provide a shirt finishing machine constructed such that the front bodice of a shirt having overlapped cloth portions can be rapidly press finished and the efficiency of the shirt pressing operation can be increased.

SUMMARY OF INVENTION

As illustrated in FIG. 1 and the like, the present invention is formed to be provided with a torso on which a shirt is put, and press irons for depressing the front part and rear part of the torso to press finish a shirt. The torso is formed by plates oppositely arranged at the front part and rear part of the torso. Then, the present invention is constructed such that a steam flowing pipe for use in heating the front side plate is installed at a position corresponding to the front bodice of the shirt at the rear side of the front plate.

Accordingly, in accordance with the present invention, the front bodice of a shirt having cloth overlapped portions can be rapidly dried in cooperation with the press irons and the shirt can be press finished efficiently within a short period of time because the front side plate can be heated.

The front bodice of a shirt in this case is meant by a portion extending from the throat to the lower end of the front bodice where the front buttons and button holes of the shirt are formed. In addition, the position corresponding to the front part of a shirt is meant by a position just rear side of the front bodice or a position of one side slightly displaced to either right or left from the position just rear side of the front bodice or both side positions. In the case of the present invention, the steam flowing pipe is formed by metallic materials such as copper, copper alloy and aluminum having a superior thermal conductivity. In addition, the steam flowing pipe is arranged at the rear side of the front side plate while being directly contacted with it or fixed to a reinforcing rib at the rear side of the front side plate and then arranged to enable heat to be transferred to the front side plate through the reinforcing rib.

Additionally, it is preferable in the present invention that the steam flowing pipe is arranged to be communicated with the upper rear side of the front side plate and at a position corresponding to a shirt pocket.

In accordance with this arrangement, a reason why this state occurs consists in the fact that when a pocket is formed in a shirt, the pocket position can be dried quickly. It is also applicable that the position corresponding to the pocket is an upper one side of the front plate or both sides of the front plate. In this case, the expression of " . . . is arranged to be communicated with . . . " means that the steam flowing pipe is in a continuous state between a position corresponding to the front part and a position corresponding to the pocket. More practically, this state can be realized by being formed with a continuous connected state (in one stroke) or branched from the position corresponding to the front part and arranged at the position corresponding to the pocket. In addition, it is also applicable that the steam flowing pipe is bent in a lateral direction at the position corresponding to the pocket, or arranged in a zig-zag form (refer to FIG. 3) or formed in a sinusoidal shape.

As shown in FIG. 4 or the like, it is also applicable in the present invention that the steam flowing pipe is formed at the position corresponding to the pocket opening of a shirt while being provided with a heat transferring part extending in a lateral direction to heat the front side plate.

Because, in accordance with this arrangement, it is possible to dry quickly the folded-back part corresponding to the pocket opening. The heat transferring part is formed into a plate shape like the steam flowing pipe by metallic material of superior thermal conductivity, for example, copper, copper alloy and aluminum or the like. In addition, this thermal transferring part is arranged such that the plate surface for improving a thermal conductivity is abutted against the rear surface of the front side plate, installed at the steam flowing pipe arranged in parallel with it, for example, or protruded in a lateral direction from the steam flowing pipe and its extremity end is released.

DESCRIPTION OF PREFERRED EMBODIMENTS

Figure 1:
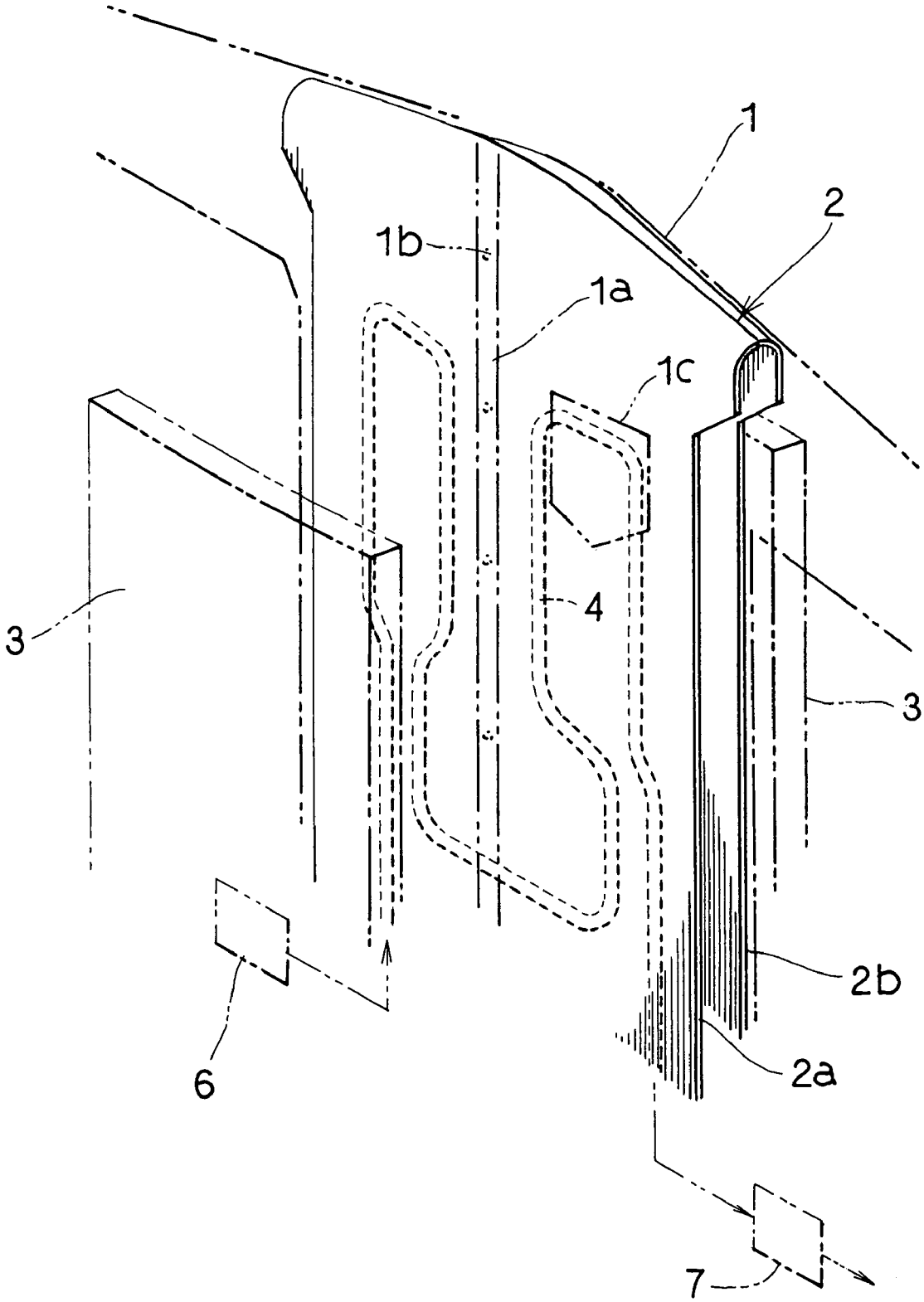
FIG. 1 is a substantial perspective view for showing one preferred embodiment of a shirt finishing machine of the present invention.

Referring now to the drawings, the preferred embodiments of the present invention will be described.

As shown in FIG. 1 or the like, the shirt finishing machine of the present invention comprises a torso 2 on which a shirt 1 is put, and press irons 3 for depressing the front part and rear part of the torso 2 to press finish the shirt 1. The aforesaid torso 2 is formed by a front side plate 2*a* and a rear side plate 2*b* oppositely arranged at the front side and rear side of the torso.

Reference numeral 4 denotes a steam flowing pipe for use in heating the front side plate 2*a*. The steam flowing pipe 4 is formed by a copper pipe, for example, and arranged at a position corresponding to the front part 1*a* (a part where front buttons 1*b* and the button holes of the shirt 1 are formed and extending from a throat to the lower end of the front bodice) at the rear side of the front side plate 2*a*. In the case of the preferred embodiment, the steam flowing pipe 4 is extended in a parallel state in an upright direction at the right and left rear sides of the front part 1*a* while holding the front part 1*a* and arranged.

Figure 2:
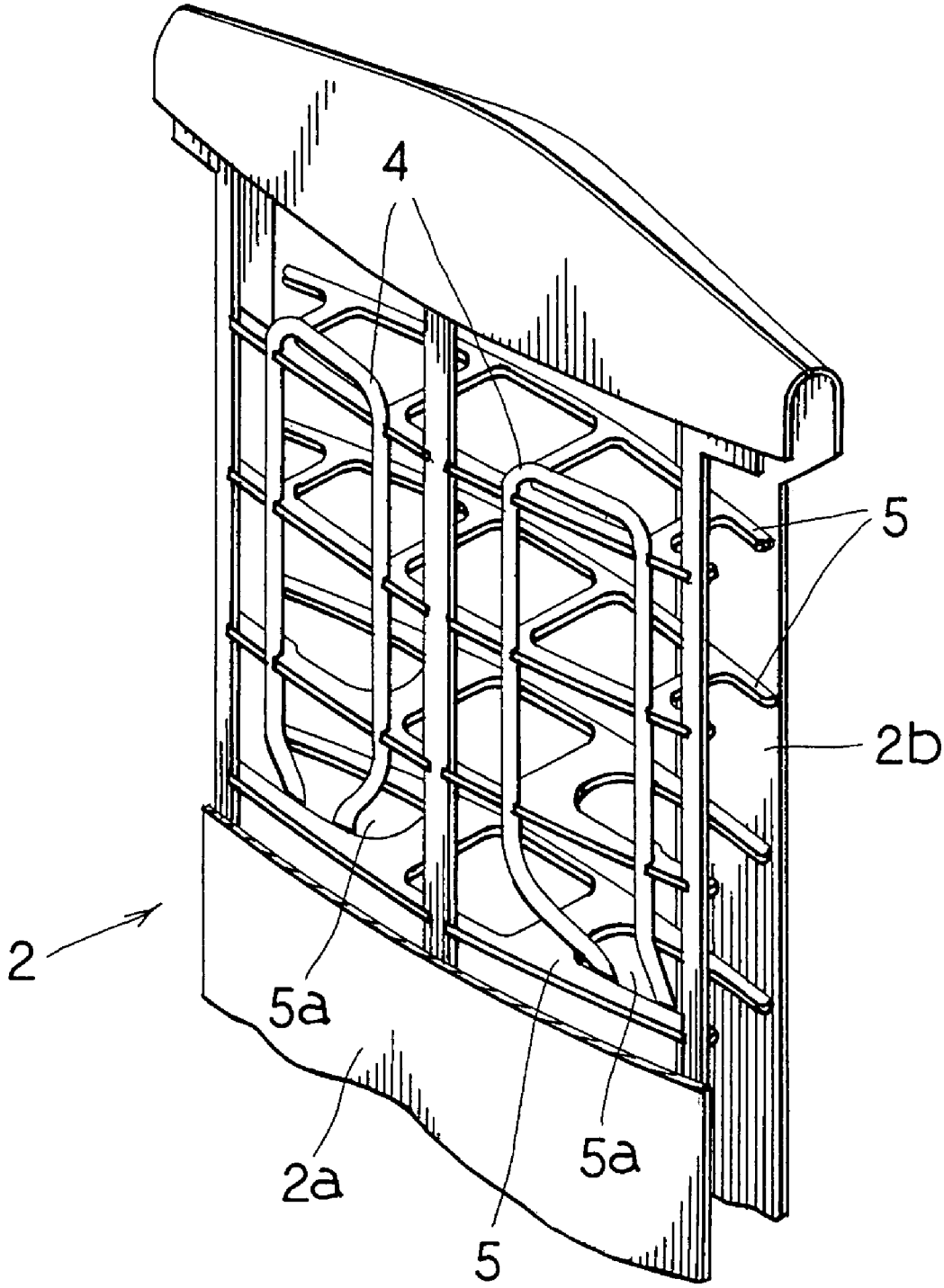
FIG. 2 is a substantial perspective view for showing the shirt finishing machine with a part of the front side plate being broken away.

In addition, in the case of the preferred embodiment, the steam flowing pipe 4 is arranged in communication with a position corresponding to the pocket 1*c* of the shirt 1 at the upper rear side of the front side plate 2*a*. More practically, as shown in FIGS. 1 and 2, the steam flowing pipe 4 is raised up from the left end as seen from the front elevational view of the torso 2, extended horizontally at the left upper part of the front plate 2*a*, raised up along the front part 1*a* at the right side of the torso 2, the right upper part is extended horizontally, raised down at the right end of the torso 2 from the right upper part and formed to be integrally connected to each other. In addition, the steam flowing pipe 4 is arranged directly with the rear side of the front side plate 2*a*. Further, as shown in FIG. 2, the lower position of the steam flowing pipe 4 is passed through the pipe hole 5*a* of the reinforcing rib 5 and arranged.

Reference numeral 6 (refer to FIG. 1 or the like) denotes a source of supplying steam. The steam flowing pipe 4 is connected to the supplying source 6. In addition, reference numeral 7 denotes a gas-water separator for removing moisture from vapor of which temperature is decreased through a heating exchanging operation with the front side plate 2*a*.

Next, an action of the present invention will be described as follows.

The present invention is operated such that the steam flows along the front part 1*a* and heats the central position of the front side plate 2*a* corresponding to the front part 1*a* through heat exchanging action over its upright direction. Accordingly, in the present invention, the front side plate 2*a* dries the front part 1*a* of the shirt 1 in cooperation with the press irons 3. In addition, since the position of the front side plate 2*a* corresponding to the pocket 1*c* is heated, in the case that the pocket 1*c* is formed at the shirt 1, the front side plate 2*a* rapidly dries the position of the pocket 1*c* of the shirt 1.

In addition, the steam flowing pipe 4 in this preferred embodiment is extended up to the right and left upper portions of the torso 2 as described above and arranged such that the steam flows laterally at the right and left upper portions. Accordingly, in accordance with the present invention in this preferred embodiment, when steam is injected into the sleeves of the shirt 1 to wet the sleeves to expand them and finish them in tension, even if the steam injected into the sleeves is drained to wet the upper part of the front bodice, the upper portion of the front side plate 2*a* is heated, so that the upper part of the front bodice of the shirt 1 can be dried rapidly and positively and disadvantage caused by this type of drain can be completely eliminated.

Figure 3:
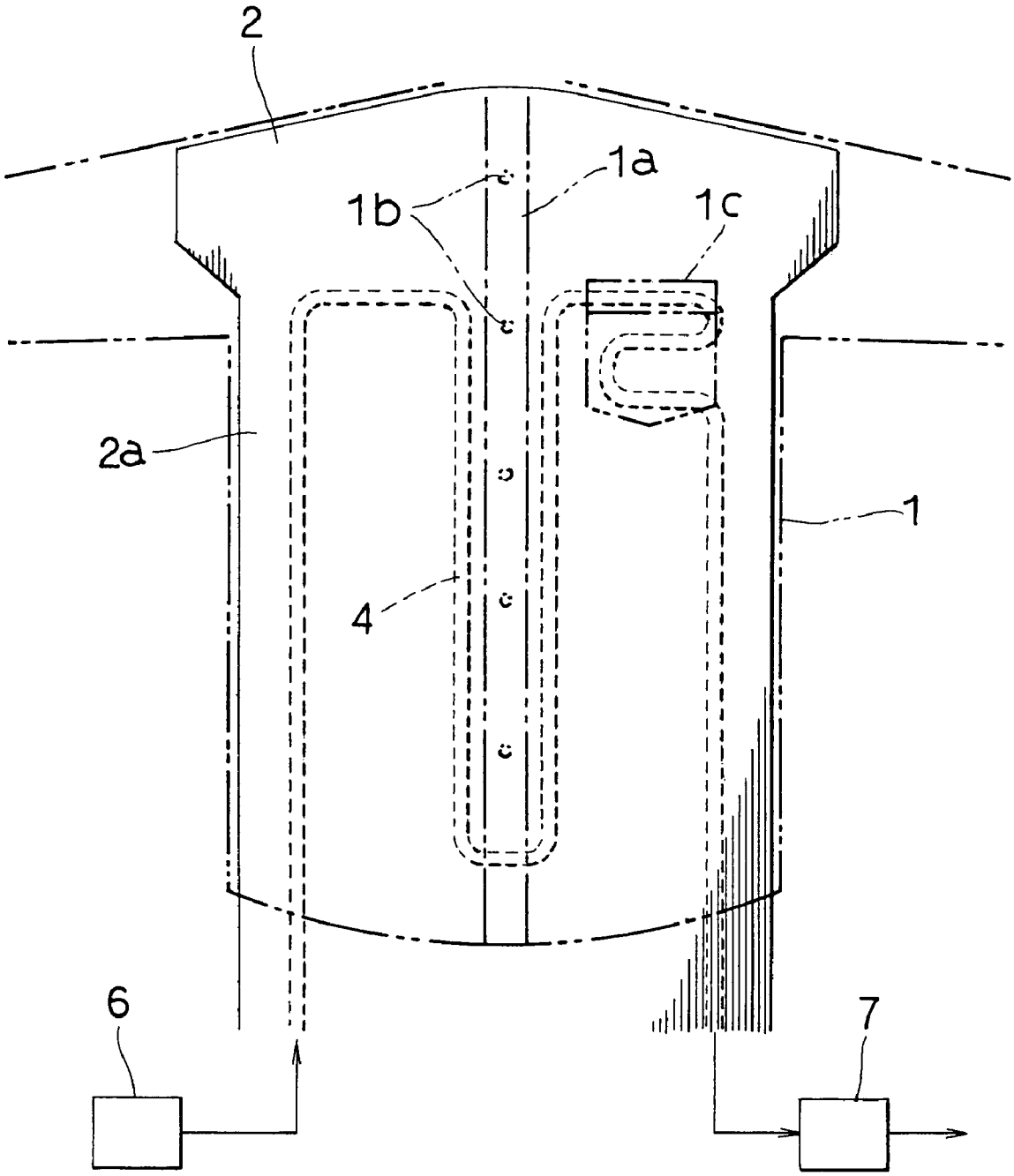
FIG. 3 is a substantial front elevational view for showing another preferred embodiment of the shirt finishing machine.

As shown in FIG. 3, the present invention in the aforesaid preferred embodiment may be applied in which the steam flowing pipe 4 is bent in a lateral direction at a position corresponding to the pocket 1*c*, i.e. the upper position at the right side as viewed from the front side of the torso 2 in this preferred embodiment and arranged in a zig-zag form. In this case, a time where steam flows is extended at the position of the pocket 1*c* and the position of the front side plate 2*a* corresponding to the pocket 1*c* can be heated more. Accordingly, in accordance with this preferred embodiment, the position of the pocket 1*c* in the shirt 1 can be dried within a further short period of time.

Figure 4:
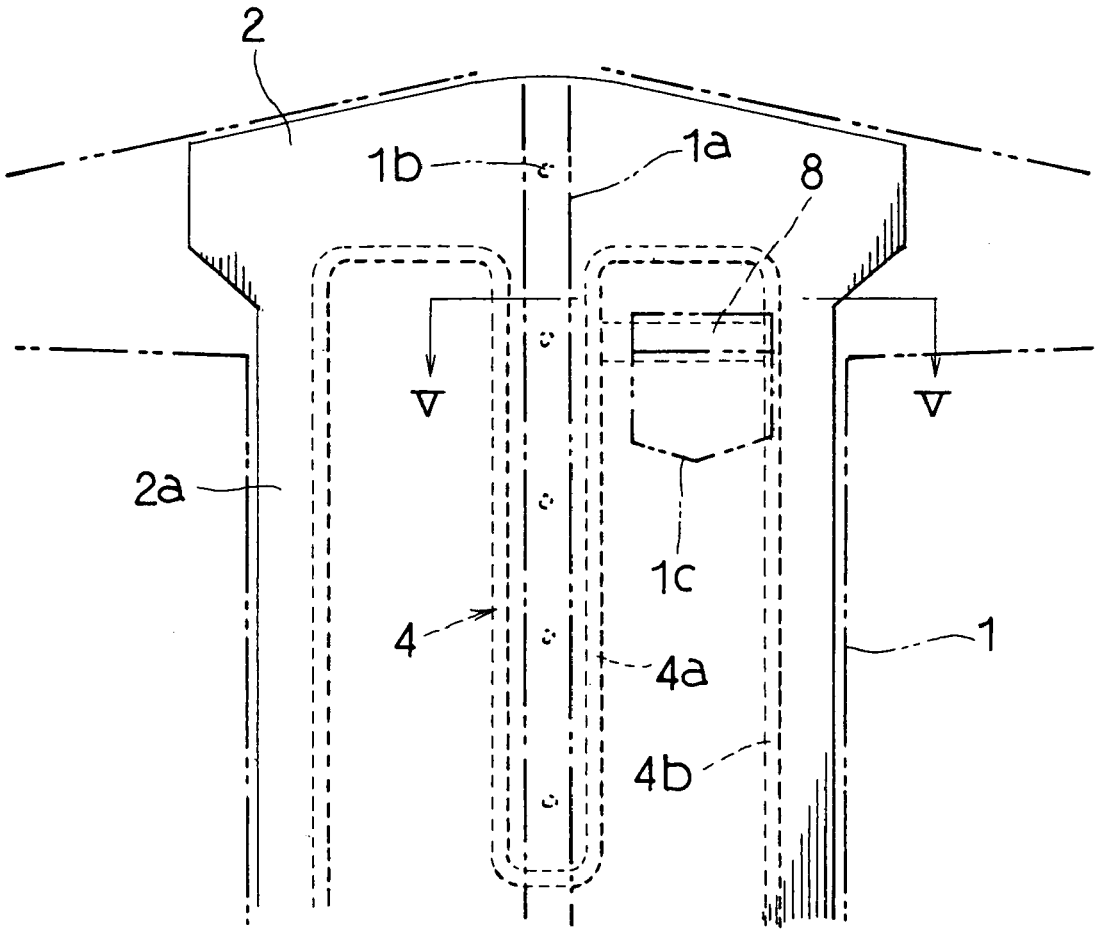
FIG. 4 is a substantial front elevational view for showing a still further preferred embodiment of the shirt finishing machine.
Figure 5:
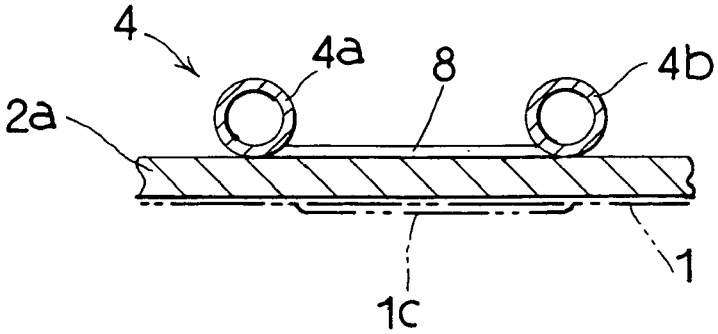
FIG. 5 is a substantial enlarged sectional view taken along line V-V of FIG. 4.

In addition, as shown in FIG. 4, the present invention may be provided in such an arrangement in which the steam flowing pipe 4 is provided with the heat transferring part 8 extending in a lateral direction to heat the front side plate 2*a* at the position corresponding to the opening of the pocket 1*c* of the shirt 1. This heat transferring part 8 is formed by metal having a superior thermal conductivity, copper, for example, in the same manner as that of the steam flowing pipe 4. In addition, this heat transferring part 8 is formed into a plate-like member, for example, and its plate surface is abutted against the rear surface of the front side plate 2*a*.

As shown in FIG. 4, the heat transferring part 8 in this preferred embodiment is constructed such that its right and left ends are connected to the right side raised portion 4*a* of the front part 1*a* and the right end descending part 4*b* as seen from the front side of the torso 2 and it is applied as a beam in a lateral direction. In the case of this invention, the position of the front side plate 2*a* corresponding to the opening of the pocket 1*c* can be heated simply and positively by changing an upright width, shape and area of the heat transferring part 8 in an appropriate manner. Accordingly, in accordance with this preferred embodiment, it can flexible accommodate for modification in specification of the torso 2.

What is claimed is:

1. A shirt finishing machine comprising a torso for putting on a shirt thereon and press irons to depress the front part and rear part of the torso to press finish the shirt, said torso being formed by plates oppositely arranged at the front part and rear part, wherein a steam flowing pipe for use in heating the front side plate is arranged at a position corresponding to the front part of the shirt at the rear side of the front plate;

wherein the steam flowing pipe is cooperatively arranged at a position corresponding to the pocket of the shirt at the upper rear side of the front side plate.

2. The shirt finishing machine according to claim 1, wherein the steam flowing pipe is formed in such a way that a position corresponding to an opening of the pocket of the shirt is provided with a heat transferring part extending in a lateral direction to heat the front side plate.

3. The shirt finishing machine according to claim 2, wherein the heat transferring part is formed into a plate-like shape with metal having a superior thermal conductivity and the plate surface is abutted against the rear surface of the front side plate.

* * * * *